US009953780B2

(12) United States Patent
Hu

(10) Patent No.: US 9,953,780 B2
(45) Date of Patent: Apr. 24, 2018

(54) EMBEDDED-POLE HV ELECTRICAL APPARATUS COMBINATION SWITCHGEAR

(71) Applicant: ZHEJIANG LIMITED CORPORATION OF DAODU INTELLIGENT SWITCH, Yuyao, Zhejiang (CN)

(72) Inventor: Guangfu Hu, Yuyao (CN)

(73) Assignee: ZHEJIANG LIMITED CORPORATION OF DAODU INTELLIGENT SWITCH, Yuyao, Zhejiang (CN)

( * ) Notice: Subject to any disclaimer, the term of this patent is extended or adjusted under 35 U.S.C. 154(b) by 0 days.

(21) Appl. No.: 15/508,981

(22) PCT Filed: Nov. 13, 2014

(86) PCT No.: PCT/CN2014/091026
§ 371 (c)(1),
(2) Date: Mar. 6, 2017

(87) PCT Pub. No.: WO2016/065673
PCT Pub. Date: May 6, 2016

(65) Prior Publication Data

US 2017/0278655 A1 Sep. 28, 2017

(30) Foreign Application Priority Data

Oct. 29, 2014 (CN) ..... 2014 1 0593358

(51) Int. Cl.
*H01H 33/666* (2006.01)
*H01H 33/12* (2006.01)
(Continued)

(52) U.S. Cl.
CPC ..... *H01H 33/6661* (2013.01); *H01H 1/58* (2013.01); *H01H 31/003* (2013.01);
(Continued)

(58) Field of Classification Search
CPC ..... H01H 33/6661; H01H 33/66207; H01H 33/121; H01H 33/666; H01H 33/662;
(Continued)

(56) References Cited

U.S. PATENT DOCUMENTS 7,227,091 B2 * 6/2007 Gacond ..... H01H 3/44 200/17 R
8,710,388 B2 * 4/2014 Utsumi ..... H01H 31/003 218/120
(Continued)

FOREIGN PATENT DOCUMENTS

CN 201237999 Y 5/2009
CN 203434515 U 2/2014
(Continued)

OTHER PUBLICATIONS

May 28, 2015 International Search Report issued in International Patent Application No. PCT/CN2014/091007.
(Continued)

*Primary Examiner* — Renee Luebke
*Assistant Examiner* — William Bolton
(74) *Attorney, Agent, or Firm* — Oliff PLC

(57) ABSTRACT

A "five-prevention" interlocking pole type high-voltage switchgear includes a pole bracket, embedded poles, and spring and earthing isolated switch operating mechanisms; every three poles are arranged in a row on the bracket, the spring operating mechanism is joined with the switch operating mechanism through the chamber door interlocking piece and mechanism interlocking piece; the chamber interlocking piece, mechanism interlocking piece and door lock plate are joined, the door lock plate is opposite the opening semi-axis pinch plate in the spring operating mechanism and the door lock plate is set with a door lock pin. Chamber interlocking piece movement is used to open or close the
(Continued)

switch operating mechanism crank operation hole and corresponds to the start of close brake operation and limit brake of opening pinch plate in the spring operating mechanism and the limiting and opening of the opening semi-axis and cable chamber door in the spring operating mechanism.

7 Claims, 7 Drawing Sheets

(51) Int. Cl.
*H01H 33/662* (2006.01)
*H01H 31/00* (2006.01)
*H01H 31/04* (2006.01)
*H01H 1/58* (2006.01)

(52) U.S. Cl.
CPC ..... *H01H 31/04* (2013.01); *H01H 33/121* (2013.01); *H01H 33/66207* (2013.01)

(58) Field of Classification Search
CPC ..... H01H 1/58; H01H 31/003; H01H 31/04; H01H 2205/002; H02B 13/01; H02B 13/035
USPC ..... 218/85, 157, 139, 134, 155, 120, 140, 218/153, 154
See application file for complete search history.

(56) References Cited

U.S. PATENT DOCUMENTS

2005/0150869 A1* 7/2005 Vaghini ..... H01H 33/125 218/118
2012/0132622 A1* 5/2012 Yamazaki ..... H02B 1/56 218/118
2014/0175059 A1* 6/2014 Huang ..... H01H 33/66207 218/136

FOREIGN PATENT DOCUMENTS

CN 104201041 A 12/2014
CN 204117946 U 1/2015
CN 104409273 A 3/2015
CN 204257488 U 4/2015

OTHER PUBLICATIONS

Feb. 21, 2017 International Preliminary Report on Patentability issued in International Patent Application No. PCT/CN2014/091007.
Apr. 1, 2015 Search Report issued in International Patent Application No. PCT/CN2014/091026.
May 2, 2017 International Preliminary Report on Patentability issued in International Patent Application No. PCT/CN2014/091026.
U.S. Appl. No. 15/506,888, filed Feb. 27, 2017.

* cited by examiner

EMBEDDED-POLE HV ELECTRICAL APPARATUS COMBINATION SWITCHGEAR

FIELD OF TECHNOLOGY

This invention relates a high-voltage electrical switchgear, specifically as an Embedded-Pole HV Electrical Apparatus Combination Switchgear.

BACKGROUND OF THE INVENTION

The high-voltage electrical switchgear refers to a combination set of modules which is used for the high-voltage switchgear, generally comprising the operating mechanism, isolated switch, load switch, breaker, position switch and other mechanisms and components relating to the high-voltage switches. And some high-voltage electrical switchgear also uses the structure and function of embedded pole which is formed by simultaneously embedding the conductive parts of the vacuum interrupter and breaker into one easily curable solid insulating material such as epoxy resin, so that all breaker poles are made as a one-piece component. Such embedded pole high-voltage electrical switchgears, for example, the Patent Serial No.: ZL200820095411.3 granted on May 13, 2009 and published in China Patent References with the Utility Model titled "A large-current casting pole type circuit breaker", wherein the electrical part of the vacuum circuit breaker comprises three poles and each pole includes the vacuum interrupter, the upper conductive element and the lower conductive element with the following characteristics: The said vacuum interrupter, the upper conductive element and the lower conductive element are cast into one piece using resin to form the poles, and the center distance between two adjacent poles is 230 mm; as resin is used to cast these elements into one-piece poles, the size of poles is greatly reduced, and accordingly, the center distance between two adjacent poles is greatly shortened, thus narrowing the cabinet width of the high-voltage switch cabinet which loads the said breaker, so that the high-voltage switch cabinet is ultimately miniaturized. However, the function and combination of the said high-voltage electrical switchgear are still single with low degree of structural integration and modularization, which is more difficult to be applied to the high-voltage switchgear requiring various functions at the same time.

BRIEF SUMMARY AND OBJECTS OF THE INVENTION

To overcome these deficiencies, the object of the invention is to provide an Embedded-Pole HV Electrical Apparatus Combination Switchgear with "five-prevention" interlocking, so that the low degree of integration and modularization, uneasy assembling or disassembling, operation, maintenance and other technical issues found in similar products can be resolved. The object is accomplished by the following technical solution.

An Embedded-Pole HV Electrical Apparatus Combination Switchgear disclosed herein comprises the pole bracket, the embedded poles, the spring operating mechanism and the earthing isolated switch operating mechanism; the screw rod and insulated rod of the said embedded poles extend out of the seal base and lead out the upper pole and the lower pole respectively, a vacuum interrupter is provided within the embedded pole; the screw rod of the said embedded pole is load rod, the insulated rod is isolated rod, the upper pole is connection bus and the lower pole is connection outlet.

Every three of the embedded poles is arranged on the pole bracket which is shaped in triangular column framework, a seal flange is provided at the hole of pole bracket where the base of embedded pole is fixed, the pole bracket at this side has an embedded triangular notch in which the spring operating mechanism and the earthing isolated switch operating mechanism are provided, the output shaft of the earthing isolated switch operating mechanism is connected with the screw rod corresponding to the embedded pole; so that the embedded pole, the spring operating mechanism and the earthing isolated switch operating mechanism are connected and assembled as an one piece through the pole bracket, which serves as a combination unit module in switch device for the high-voltage equipment. With respect to its structural design, the main points are: the mounting base plate of the said spring operating mechanism is provided with an operating shaft with the symmetrical crank arms which are connected to the ear bases at both sides, each ear base is provided with an ear slide opening, the insulated rod of embedded pole extends out of the limit hole formed between the symmetrical crank arm and the shaft pin; The earthing isolated switch operating mechanism is provided in the triangular notch of pole bracket through the mounting base plate of the spring operating mechanism, the earthing isolated switch operating mechanism is located in the upper part of the mounting base plate of the spring operating mechanism which is connected as one piece with the earthing isolated switch operating mechanism through the chamber door interlocking piece and the mechanism interlocking piece; a plate slide opening is provided at the joint between the chamber door interlocking piece, the spring operating mechanism and the earthing isolated switch operating mechanism, a pull-up tension spring is provided at the inner side of the tension spring pin of the chamber door interlocking piece, one end of the chamber door interlocking piece is located at the operating hole of the crank in the earthing isolated switch operating mechanism while its other end is located at the opening semi-axis pinch plate in the spring operating mechanism; a rotary disc interlocking piece is provided at the opening semi-axis pinch plate in the spring operating mechanism with the raised rim part of its one end offsetting the chamber door interlocking piece, a raised knob is provided in the rim of rotary disc interlocking piece, the upward movement is driven by the chamber door interlocking piece offsetting the raised rim part of the rotary disc interlocking piece. The embedded poles as vacuum breakers and vacuum load switches and the spring operating mechanism and the earthing isolated switch operating mechanism make up the position isolated switchgear which is used as position switchgear or isolated switchgear, the earthing isolated switch operating mechanism is structured in three-position switch or two-position switch, so that such high-voltage electrical switchgear has five combination sets: load switches+three-position switchgear, breaker+three-position switchgear, isolated switchgear, breaker+isolated switchgear, and load switches+isolated switchgear. The top or bottom position of the chamber door interlocking piece is used to open or close the crank operation hole of the earthing isolated switch operating mechanism respectively and corresponds to the start of closing operation and limit closing of the opening semi-axis pinch plate in the spring operating mechanism through the rotary disc interlocking piece offsetting the chamber door interlocking piece and the upward and downward movement of the chamber door interlocking piece driven by the plate sliding opening of chamber door interlocking piece and the tension spring.

The crank operation end of the said chamber door interlocking piece is connected with one end of the mechanism interlocking piece as one piece and the other end is connected with one end of the door lock plate, the bottom of the door lock plate is connected with the pole bracket through the symmetrically guide pin and a compression spring is provided at the joint, the other end of the door lock plate is opposed to the opening semi-axis pinch plate of the spring operating mechanism. That is to say when the chamber door interlocking piece drives the synchronized movement of the mechanism interlocking piece through the upward and downward movement, the door lock plate drives the upward and downward movement through the mechanism interlocking piece; specifically as: when the chamber door interlocking piece is located at the end of crank operation hole of the earthing isolated switch operating mechanism, the door lock plate moves upward at the same time to block the opening semi-axis pinch plate of the spring operating mechanism disabling opening operation; when the chamber door interlocking piece is located at the end of closing semi-axis pinch plate of the spring operating mechanism, the door lock plate moves downward at the same time to leave the opening semi-axis pinch plate of the spring operating mechanism enabling opening operation.

A door lock pin is provided between the guide pins of the said door lock plate, the door lock pin extends out of the bottom part of the pole bracket. That is to say when the door lock plate drives the upward and downward movement of the mechanism interlocking piece, the door lock pin drives the upward and downward movement through the door pin plate; specifically as: when the chamber door interlocking piece is located at the end of crank operation hole of the earthing isolated switch operating mechanism, the door lock pin is driven to move upward by the door lock plate, in which case the cable chamber door can only be opened; when the chamber door interlocking piece is located at the end of opening semi-axis pinch plate of the spring operating mechanism, the door lock pin is driven to move downward by the door lock plate disabling the opening of cable chamber room, so that the complete function of "five-prevention interlocking" for the said high-voltage electrical switchgear is achieved.

The upper chamber and the lower chamber of the said embedded pole are staggered in varying length, the static and dynamic contact assembly within the upper chamber and the lower chamber is connected via the conductive base, a vacuum interrupter is provided in the lower chamber of embedded pole, the upper leading pole of embedded pole vertically leads out the embedded pole and the lower leading pole horizontally leads out the embedded pole by 90° bending, in which the embedded pole is gun-shaped. The said gun-shaped structure is "F" shaped structure and the said structure is an embedded pole structure which can be used as vacuum breaker or vacuum load switch; the upper and lower pole of such structure facilitates the wiring connection, assembling or disassembling and maintenance of such high-voltage electrical switchgear. The vacuum interrupter must be placed in opening state and the master switch is kept off before switching the isolated closing, isolated opening and earthing closing; once any position of the isolated closing, isolated opening and earthing closing is reached, then the vacuum interrupt is placed at the closing or opening state.

An earthing bar connection nut which is used for the earthing bus bar connection is provided at the top of the seal base of the said embedded pole.

A position switch is provided at the upper part of the earthing isolated switch operating mechanism, the wire from the position switch is connected with the auxiliary switch through the hub mounted on the pole bracket, the auxiliary switch is provided in the spring operating mechanism through the opening of the spring operating mechanism, the motor, the closing electromagnet and the opening electromagnet of the spring operating mechanism are connected with the auxiliary switch through the circuit; the closing electromagnet and the opening electromagnet are opposed to the closing semi-axis, opening semi-axis drive end pinch plate of the spring operating mechanism respectively, the closing/opening knob and signs are provided in the spring operating mechanism, the closing/opening knob are provided on the closing swing rod and the opening swing rod respectively, the closing spring, the energy storage gear, the energy storage cam, the connecting rod assembly and the closing/breaking pawl are provided between the clamping plate and the mounting base plate, the energy storage shaft of the energy storage gear at one end of the clamping plate extends out of the outer edge of the clamping plate. The said closing electromagnet and the opening electromagnet uses the coil structure to drive the reciprocating movement of movable iron core, enabling the electric control of closing and opening; the auxiliary switch is used for manual energy storage, and the control and signal transmission are achieved through the position switches, hubs and other circuits. And the said spring operating mechanism has a function of vacuum interrupter operating mechanism.

The said earthing isolated switch operating mechanism is a three-position locking isolated mechanism, a transition shaft gear and an output shaft gear, and the position plate assembly and connecting nut plate assembly are provided between the mounting plates in the three-position locking isolated mechanism, the unlocking shaft in the position plate assembly is connected with the unlocking lever of the unlocking assembly at the outer edge of mounting plate and the return spring and limit screw column are provided at the joint, the unlocking lever, unlocking piece is sequentially connected with the guide rod and the unlocking plate through the guide shell, the unlocking lever, unlocking piece in the unlocking assembly offsets the side roller of limit rod in the nut plate assembly, the plate structure in the nut plate assembly moves between the clamping plates through the screw rod and guide rod and also drives the unlocking pin in the nut plate assembly and the position plate location hole in the position plate assembly for fit-locking or unlocking, and the hook end of the unlocking piece passes through the crank limit slot which is provided at one output shaft in the guide shell. The said structure is one structure of the three-position locking isolated mechanism used by the earthing isolated switch operating mechanism, which can also use the similar switch operating mechanism. When such three-position locking isolated mechanism is locked at the position, the crank is turned and the screw rod drives the displacement of the plate structure of the nut plate assembly, the unlocking pin of the nut plate assembly is fit and locked to the location hole of the position plate assembly; the roller of the upper limit rod in the nut plate assembly is located at the locking slot of the unlocking plate, the unlocking plate is lifted up, when the crank can be pulled out but cannot be rotated, and then locked after the switching of position. When the position is unlocked, the unlocking piece moves outward and drives the unlocking shaft to rotate clockwise through the unlocking rod, the unlocking pin of the nut plate assembly is fit and locked to the location hole of the position plate assembly; The screw rod drives the displacement of the plate structure of the nut plate assembly, the roller of the limit rod moves to the unlocking slot of the unlocking plate, the unlocking plate drops down, the unlocking lever, the unlocking piece, the guide rod and the unlocking plate in the unlocking assembly are tightly interlocked; in that situation, the crank cannot be pulled out but can be rotated, according to the operation when the above position is locked. The crank is continuously swung to move and loosen the unlocking piece outward once again, namely performing the switching of position.

The invention is structurally designed to be reasonable, compact, small which facilitates the assembling or disassembling, use and maintenance with high degree of integration and modularization and good safety and stability; suitably used as vacuum breaker or vacuum load switch and applicable to the high-voltage switch module of three-position switch and operating mechanism, as well as the structural modification for similar products.

The numbers indicated in the above figures denote: 1. Pole bracket, 2. Embedded pole, 201. Seal base, 3. Spring operating mechanism, 301. Mounting base plate, 302. Crank arm, 303. Operating shaft, 304. Closing electromagnet, 305. Opening electromagnet, 306. Closing electromagnet, 4. Earthing isolated switch operating mechanism. 401. Crank, 402. Unlocking shaft, 403. Unlocking lever, 404. Unlocking piece, 405. Guide shell, 406. Guide rod, 407. Unlocking plate, 408. Limit rod, 5. Chamber door interlocking piece, 501. Tension spring pin, 6. Mechanism interlocking piece, 7. Seal flange, 8. Motor, 9. Auxiliary switch, 10. Position switch, 11. Earthing bar connection nut, 12. Rotary disc interlocking piece, 13. Door lock plate, 14. Door lock pin.

DESCRIPTION OF THE EMBODIMENT

Figure 1:
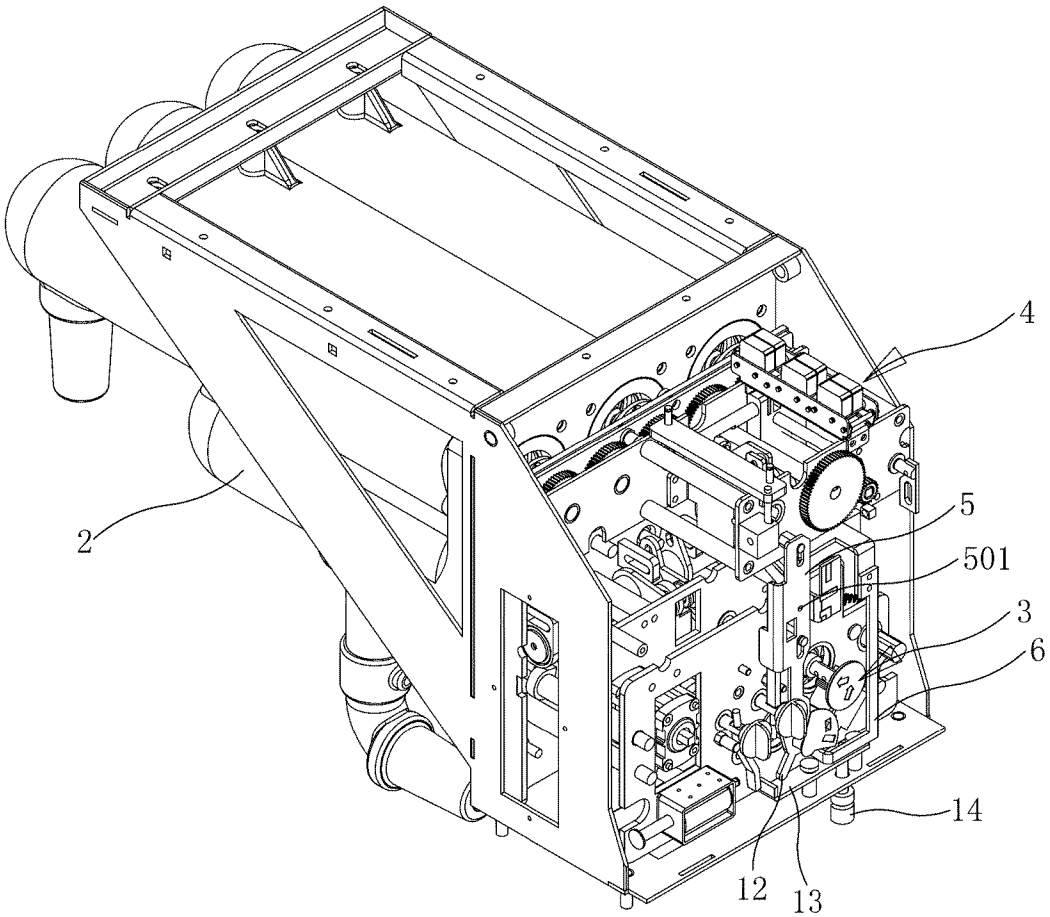
FIG. 1 is a back view of the invention which omits the structures including the crank, unlocking lever, unlocking piece and closing electromagnet.
Figure 2:
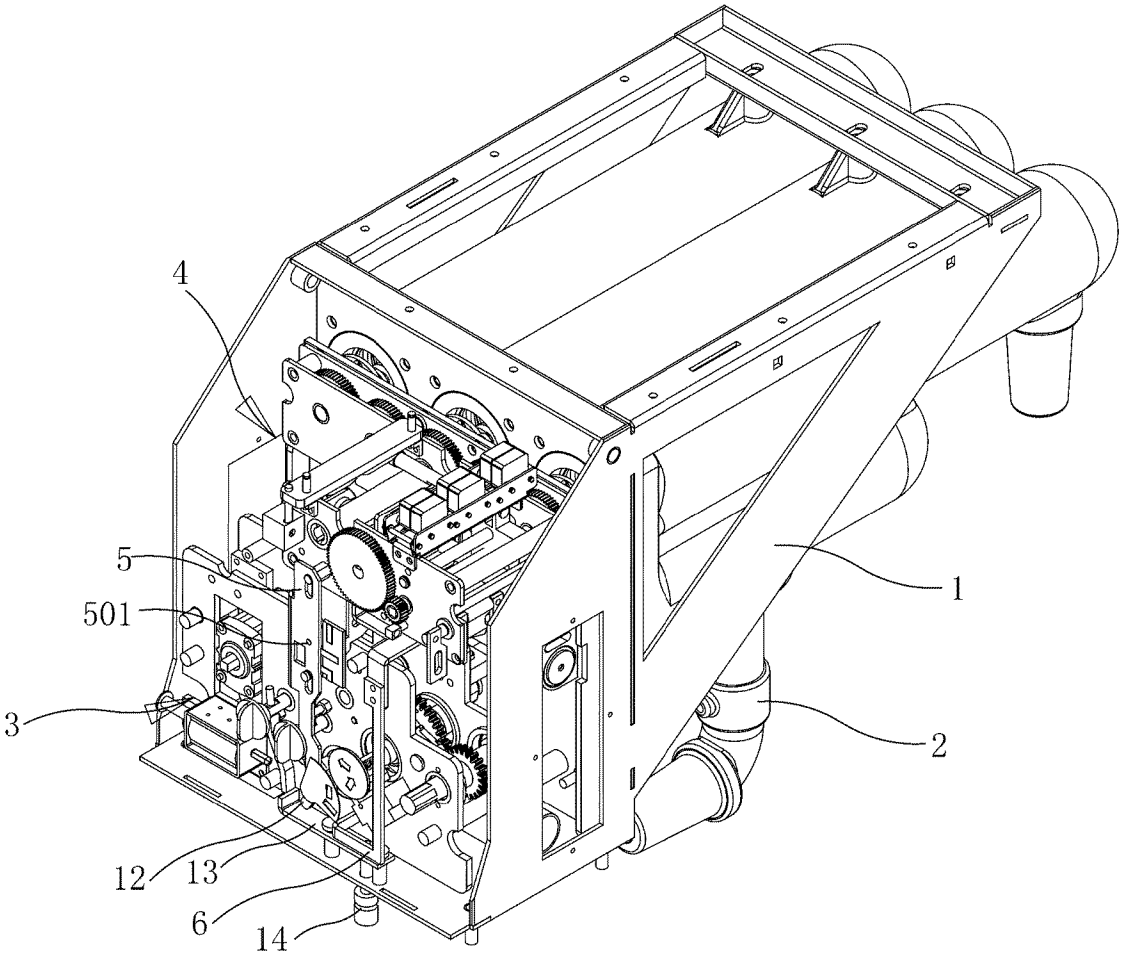
FIG. 2 is a back view of the structures of FIG. 1.
Figure 3:
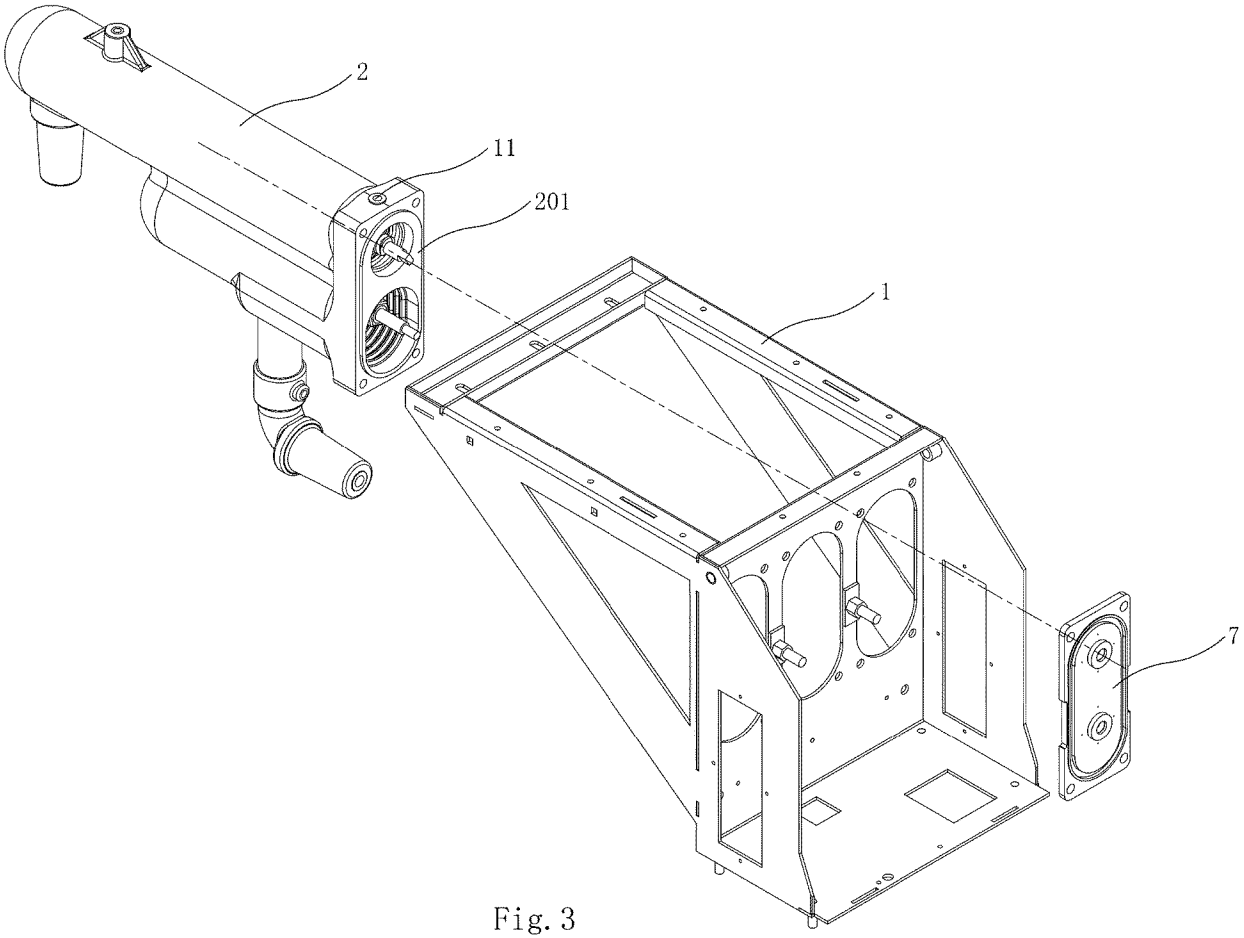
FIG. 3 is an exploded view of a portion of the invention which shows the pole bracket, the embedded pole and the seal flange.
Figure 4:
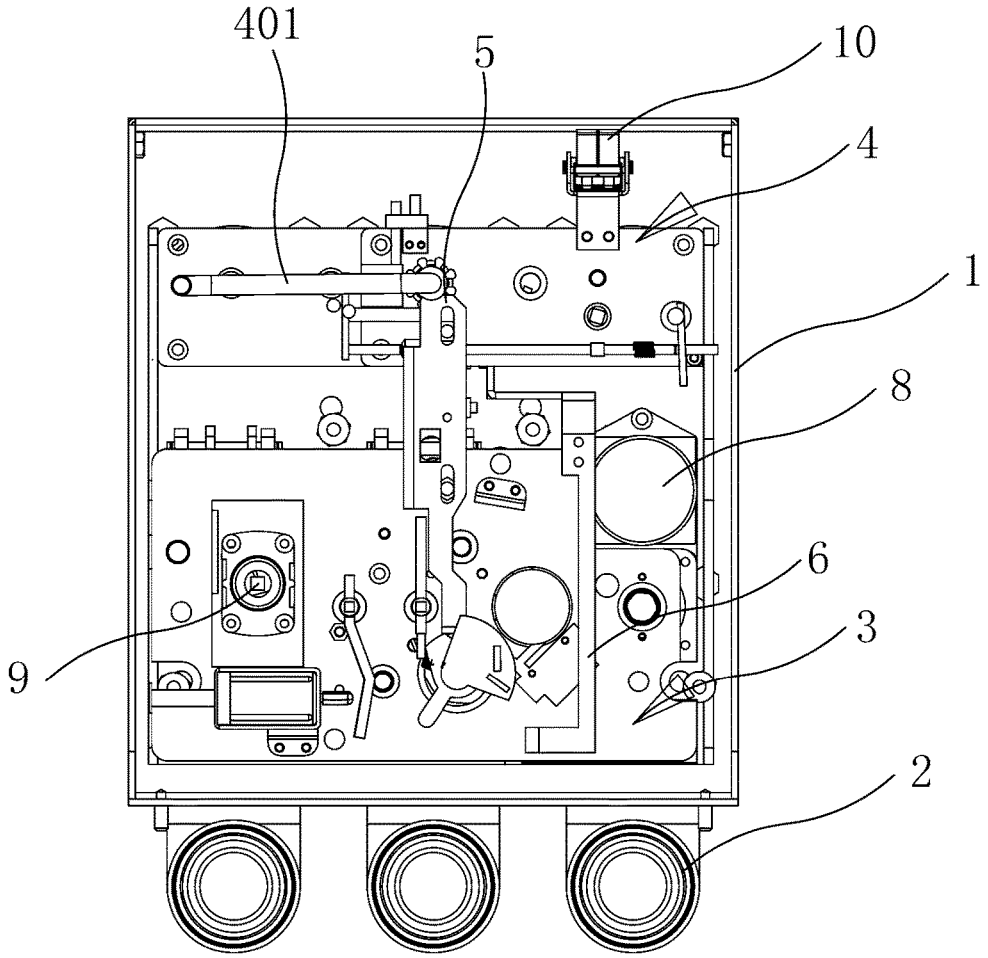
FIG. 4 is a back view of the structures of FIG. 1 which omits the structures such as the door lock plate and the door lock pin.
Figure 5:
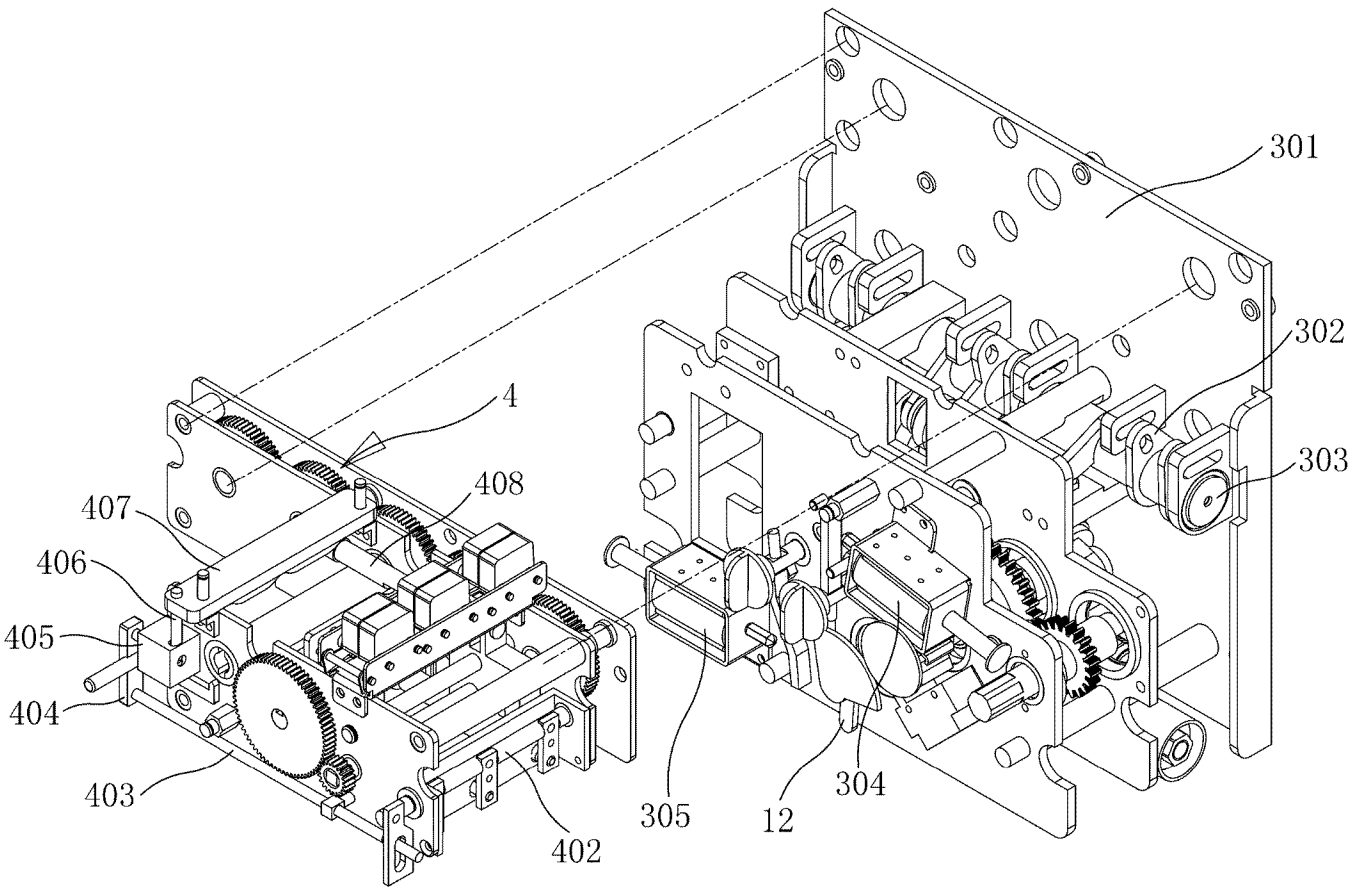
FIG. 5 is an exploded view of a portion of the invention which includes the spring operating mechanism and the earthing isolated switch operating mechanism.
Figure 6:
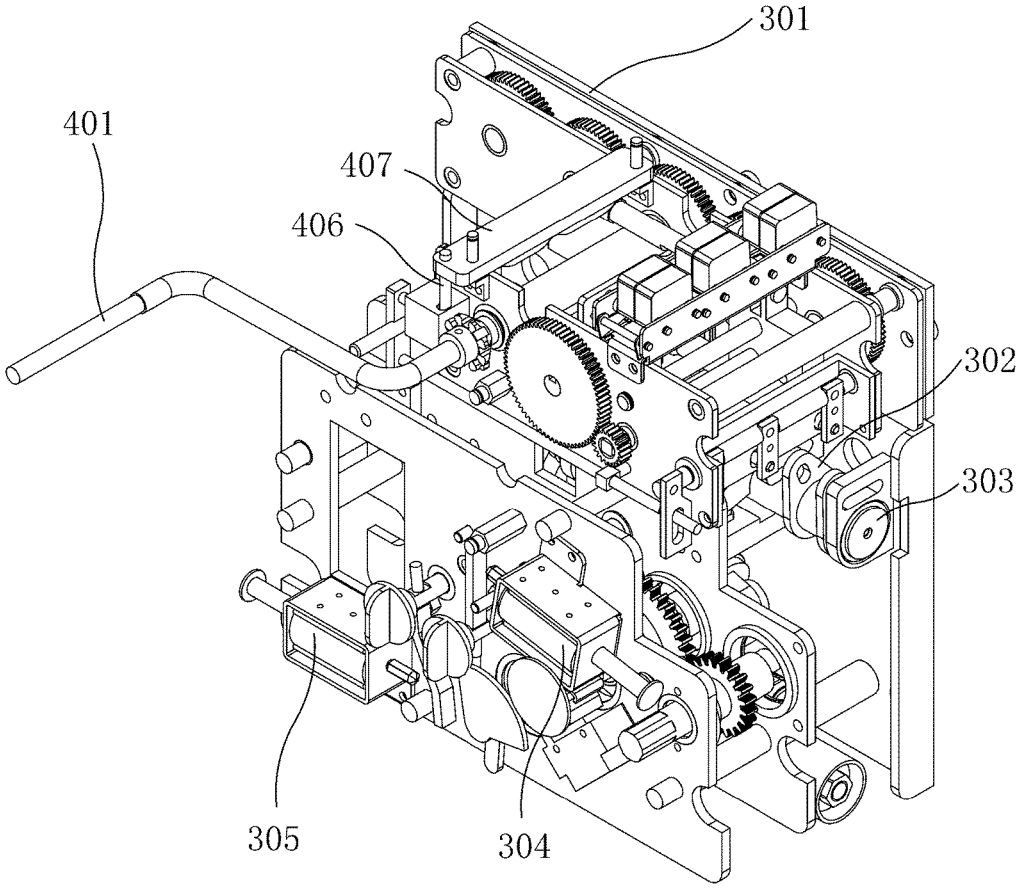
FIG. 6 is the structures of FIG. 5 being assembled in which the crank is provided.
Figure 7:
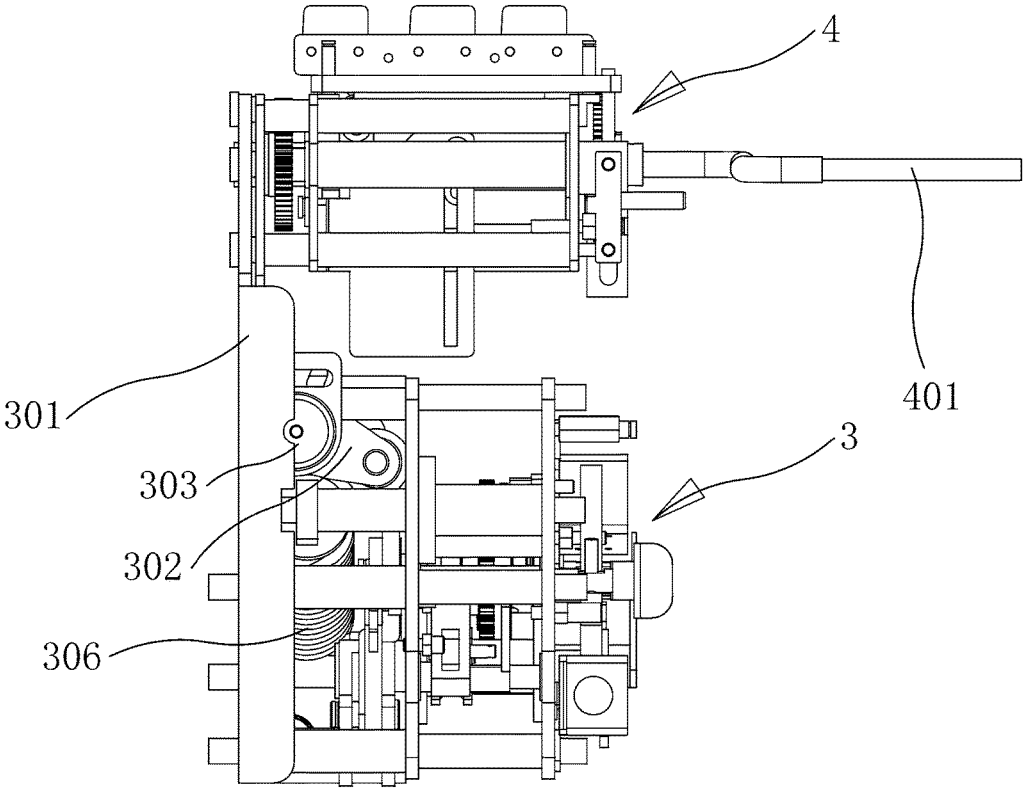
FIG. 7 is a left view of a portion of the structures of FIG. 6.

Now the invention is further disclosed with reference to the drawings. As shown in FIG. 1 through FIG. 7, such high-voltage electrical switchgear comprises the pole bracket 1, the embedded pole 2, the spring operating mechanism 3 and the earthing isolated switch operating mechanism 4, the screw rod and insulated rod of the embedded pole extend out of the seal base 201 respectively, an earthing bar connection nut 11 is provided at the top of the seal base of embedded poles, the screw rod and insulated rod lead out the upper pole and the lower pole respectively, a vacuum interrupter is provided in the embedded pole; the upper chamber and the lower chamber of the said embedded pole are staggered in varying length, the static and dynamic contact assembly within the said upper chamber and the lower chamber is connected via the conductive base, a vacuum interrupter is provided in the lower chamber of embedded pole, the upper pole of embedded pole vertically leads out the embedded pole and the lower pole horizontally leads out the embedded pole by 90° bending, in which the embedded pole is gun-shaped. Every three of the embedded poles is arranged in a row on the pole bracket which is shaped in triangular column framework, a seal flange 7 is provided at the hole of pole bracket where the base of embedded pole is fixed; the pole bracket at this side has an embedded triangular notch in which the spring operating mechanism and the earthing isolated switch operating mechanism are provided, the output shaft of the earthing isolated switch operating mechanism is connected with the screw rod corresponding to the embedded pole. The mounting base plate 301 of the spring operating mechanism is provided with an operating shaft 303 with the symmetrical crank arms 302 which are connected to the ear bases at both sides, each ear base is provided with an ear slide opening, the insulated rod of embedded pole extends out of the limit hole formed between the symmetrical crank arm and the shaft pin; the earthing isolated switch operating mechanism is provided in the triangular notch of pole bracket through the mounting base plate of the spring operating mechanism, the earthing isolated switch operating mechanism is located in the upper part of the mounting base plate of the spring operating mechanism which is connected as one piece with the earthing isolated switch operating mechanism through the chamber door interlocking piece 5 and the mechanism interlocking piece 6. A plate slide opening is provided at the joint between the chamber door interlocking piece, the spring operating mechanism and the earthing isolated switch operating mechanism, a pull-up tension spring is provided at the inner side of the tension spring pin 501 of the chamber door interlocking piece, one end of the chamber door interlocking piece is located at the operating hole of the crank 401 in the earthing isolated switch operating mechanism while its other end is located at the closing semi-axis pinch plate in the spring operating mechanism; a rotary disc interlocking piece 12 is provided at the opening semi-axis pinch plate in the spring operating mechanism with the raised rim part of its one end offsetting the chamber door interlocking piece, a raised knob is provided in the rim of rotary disc interlocking piece.

In the said structure, the chamber door interlocking piece drives the upward movement to block the crank operation hole of the earthing isolated switch operating mechanism by offsetting the rim raised part of the rotary disc interlocking piece, so that the crank of the earthing isolated switch operating mechanism cannot be inserted; the other end of the chamber door interlocking piece fits into the closing semi-axis pinch plate which leaves the spring operating mechanism, enabling the closing of the spring operating mechanism. The rim raised part of the rotary disc interlocking piece is separated from the chamber door interlocking piece by turning the rotary disc interlocking piece via the knob on the rotary disc interlocking piece, the chamber door interlocking piece returns through the tension spring, the crank operation hole of the earthing isolated switch operating mechanism is opened, the other end of the chamber door interlocking piece fits into the closing semi-axis pinch plate which blocks the spring operating mechanism, disabling the closing of the spring operating mechanism.

Meanwhile, the crank operation hole end of the said chamber door interlocking piece is joined as one entity with one end of the mechanism interlocking piece, the other end of the mechanism interlocking piece is connected with one end of the door lock plate 13, the bottom of the door lock plate is connected with the pole bracket through the symmetrically provided guide pin and a compression spring is provided at the joint, the other end of the door lock plate is opposed to the opening semi-axis pinch plate in the spring operating mechanism; a door lock pin 14 which extends out of the bottom of pole bracket is provided between the guide pins of the said door lock plate. By this means, when the earthing isolated switch operating mechanism is at the earthing position, the chamber door interlocking piece moves upward to leave the door lock plate; when the breaker mechanism is at the closing position, the rotary disc interlocking piece is also at this position; in that situation, the door lock plate as driven by the mechanism interlocking plate will drive the door lock pin to move upward, so that the cable chamber door can be opened; and when the door lock plate moves upward, the door lock plate will block the opening semi-axis pinch plate of the spring operating mechanism, disabling the opening of the spring operating mechanism; in the said structure, the door lock drives the returning through the tension spring and the door lock plate. That is to say when the spring operating mechanism of such high-voltage electrical switchgear is at the closing position, the earthing isolated switch operating mechanism is not allowed to operate; when the earthing isolated switch operating mechanism is at the isolated closing position or the earthing closing position, the spring operating mechanism can be closed/opened; when the earthing isolated switch operating mechanism is at the earthing position and the spring operating mechanism is at the closing position, the cable chamber door can be opened; after opening the cable chamber door, the spring operating mechanism cannot be opened; during the switching process of position of the earthing isolated switch operating mechanism, the spring operating mechanism doesn't allow for the "five-prevention interlocking" of the spring operating mechanism.

In addition, a position switch 10 is provided at the upper part of the earthing isolated switch operating mechanism, the wire from the position switch is connected with the auxiliary switch 9 through the hub mounted on the pole bracket, the auxiliary switch is provided in the spring operating mechanism through the opening of the spring operating mechanism, the motor 8, the closing electromagnet 304 and the opening electromagnet 305 of the spring operating mechanism are connected with the auxiliary switch through the circuit; the closing electromagnet and the opening electromagnet are opposed to the closing semi-axis, opening semi-axis drive end pinch plate of the spring operating mechanism respectively, the closing/opening knob and signs are provided in the spring operating mechanism, the closing/opening knob are provided on the closing brake swing rod and the opening swing rod respectively, the closing spring 306, the energy storage gear, the energy storage cam, the connecting rod assembly and the closing/breaking pawl are provided between the clamping plate and the mounting base plate, the energy storage shaft of the energy storage gear at one end of the clamping plate extends out of the outer edge of the clamping plate. The said earthing isolated switch operating mechanism is a three-position locking isolated mechanism, a transition shaft gear and an output shaft gear, and the position plate assembly and connecting nut plate assembly are provided between the mounting plates in the three-position locking isolated mechanism, the unlocking shaft 402 in the position plate assembly is connected with the unlocking lever 403 of the unlocking assembly at the outer edge of mounting plate and the return spring and limit screw column are provided at the joint, the unlocking lever, unlocking piece 404 is sequentially connected with the guide rod 406 and the unlocking plate 407 through the guide shell 405, the unlocking lever, unlocking piece in the unlocking assembly offsets the side roller of limit rod in the nut plate assembly, the plate structure in the nut plate assembly moves between the clamping plates through the screw rod and guide rod and also drives the unlocking pin in the nut plate assembly and the position plate location hole in the position plate assembly for fit-locking or unlocking, and the hook end of the unlocking piece passes through the crank limit slot which is provided at one output shaft in the guide shell.

While in use, such high-voltage electrical switchgear is installed in the corresponding high-voltage switchgear cabinet, the upper pole of the embedded pole is connected with the bus and the lower pole is connected with the outgoing cable, the earthing bus bar nut is joined with the earthing bus bar, a panel is provided on the outer slope of the pole bracket, and the panel window openings correspond to the manual energy storage hole, the crank insertion hole, the opening/closing knob and signs. The manual energy storage shaft is operated if the manual energy storage is required; the crank is inserted to the earthing isolated switch operating mechanism and then the crank is swung for the switching of position if the manual three-position isolated operation is required; the opening/closing knob is just turned if the electric opening/closing is required.

In conclusion, three embedded poles and an integrated operating interlocking mechanism of the invention are mounted at the front and rear part of the pole bracket, specifically as: three embedded poles are arranged in parallel; the spring operating mechanism and the earthing isolated switch operating mechanism are combined as an integrated operating interlocking mechanism which is arranged in the upper and lower section with interlocking control; the pole bracket is an integrated bracket formed by welding profile material. This invention is an integrated combination unit module in the high-voltage switches which has vacuum breakers or vacuum load switches with the function of three-position switch and operating mechanism; the overall dimensions are exactly the same under the status of the said function, the switching of the pole combination sets of different functions can be achieved through various mechanisms. Specifically, it can be divided into five combination sets: load switches+three-position switchgear, breaker+three-position switchgear, isolated switchgear, breaker+isolated switchgear, and load switches+isolated switchgear and with a complete five-prevention interlocking function, so that the switchgear cabinet doesn't need any interlocking. Meanwhile, the poles are entirely sealed and three positions are air-insulated to achieve the purpose of environmental protection and safety. It is applicable to the solid-insulated switchgear, gas insulated switchgear, and other composite insulated switchgear or similar products, which can be used as a combination unit module.

The invention claimed is:

1. An Embedded-Pole High-Voltage Electrical Apparatus Combination Switchgear comprising:

a pole bracket;

a plurality of embedded poles;

a spring operating mechanism; and an earthing isolated switch operating mechanism, wherein:

a screw rod and an insulated rod of the embedded poles extend out of a seal base and lead out an upper pole and a lower pole, respectively;

a vacuum interrupter is provided within the embedded pole;

three embedded poles are arranged in a row on the pole bracket that is shaped in a triangular column framework;

a seal flange is provided at a hole of the pole bracket on a first side of the pole bracket where the embedded pole is fixed, the first side of the pole bracket has an embedded triangular notch in which the spring operating mechanism and the earthing isolated switch operating mechanism are provided;

an output shaft of the earthing isolated switch operating mechanism is connected with the screw rod corresponding to the embedded pole;

a mounting base plate of the spring operating mechanism is provided with an operating shaft, with a plurality of symmetrical crank arms which are connected a plurality of ear bases at both sides, each ear base is provided with an ear slide opening;

the insulated rod of the embedded pole extends out of a limit hole formed between the symmetrical crank arm and a shaft pin;

the earthing isolated switch operating mechanism is provided in the triangular notch of pole bracket through the mounting base plate of the spring operating mechanism, the earthing isolated switch operating mechanism is located in an upper part of the mounting base plate of the spring operating mechanism which is connected as one piece with the earthing isolated switch operating mechanism through a chamber door interlocking piece a mechanism and interlocking piece piece;

a plate slide opening is provided at a joint between the chamber door interlocking piece, the spring operating mechanism and the earthing isolated switch operating mechanism;

a pull-up tension spring is provided at an inner side of a tension spring pin of the chamber door interlocking piece;

a first end of the chamber door interlocking piece is located at an operating hole of a crank in the earthing isolated switch operating mechanism while a second end of the chamber door interlocking piece is located at a closing semi-axis pinch plate in the spring operating mechanism;

a rotary disc interlocking piece is provided at an opening semi-axis pinch plate in the spring operating mechanism with a raised rim part offsetting the chamber door interlocking piece; and a raised knob is provided in the rim of rotary disc interlocking piece, an upward movement is driven by the chamber door interlocking piece offsetting the raised rim part of the rotary disc interlocking piece.

2. The Embedded-Pole High-Voltage Electrical Apparatus Combination Switchgear according to claim 1, further comprising:

a crank operation hole end of the chamber door interlocking piece is joined as one entity with a first end of the mechanism interlocking piece, a second end of the mechanism interlocking piece is connected with one end of a door lock plate; and a first end of the door lock plate is connected with the pole bracket through a symmetrically provided guide pin and a compression spring is provided at the joint, a second end of the door lock plate is opposed to the opening semi-axis pinch plate in the spring operating mechanism.

3. The Embedded-Pole High-Voltage Electrical Apparatus Combination Switchgear according to claim 2, further comprising:

a door lock pin which extends out of a bottom of the pole bracket is provided between the guide pins of the door lock plate.

4. The Embedded-Pole High-Voltage Electrical Apparatus Combination Switchgear according to claim 1, further comprising:

an upper chamber and a lower chamber of the embedded pole are staggered in varying length;

a static and dynamic contact assembly within the upper chamber and the lower chamber is connected via a conductive base;

the vacuum interrupter is provided in the lower chamber of embedded pole;

the upper leading pole of embedded pole vertically leads out the embedded pole and the lower leading pole horizontally leads out the embedded pole by 90° bending, in which the embedded pole is F-shaped.

5. The Embedded-Pole High-Voltage Electrical Apparatus Combination Switchgear according to claim 4, further comprising:

an earthing bar connection nut is provided at a top of the seal base of the embedded pole.

6. The Embedded-Pole High-Voltage Electrical Apparatus Combination Switchgear according to claim 1, further comprising:

a position switch is provided at an upper part of the earthing isolated switch operating mechanism;

a wire from the position switch is connected with an auxiliary switch through a hub mounted on the pole bracket, an auxiliary switch is provided in the spring operating mechanism through an opening of the spring operating mechanism;

a motor, a closing electromagnet and an opening electromagnet of the spring operating mechanism are connected with the auxiliary switch through a circuit;

the closing electromagnet and the opening electromagnet are opposed to the closing semi-axis, the opening semi-axis drive end pinch plate of the spring operating mechanism, respectively;

a closing/opening knob and signs are provided in the spring operating mechanism, the closing/opening knob are provided on a closing brake swing rod and an opening swing rod, respectively;

a closing spring, an energy storage gear, an energy storage cam, a connecting rod assembly and a closing/breaking pawl are provided between a clamping plate and the mounting base plate; and an energy storage shaft of the energy storage gear at one end of the clamping plate extends out of an outer edge of the clamping plate.

7. The Embedded-Pole High-Voltage Electrical Apparatus Combination Switchgear according to claim 1, wherein:

the earthing isolated switch operating mechanism is a three-position locking isolated mechanism;

a transition shaft gear and an output shaft gear, and a position plate assembly and connecting nut plate assembly are provided between a plurality of mounting plates in the three-position locking isolated mechanism;

an unlocking shaft in the position plate assembly is connected with an unlocking lever of an unlocking assembly at an outer edge of the mounting plate;

a return spring and limit a screw column are provided at a joint;

the unlocking lever, an unlocking piece is sequentially connected with a guide rod and an unlocking plate through a guide shell;

the unlocking lever, unlocking piece in the unlocking assembly offsets a side roller of limit rod in the nut plate assembly;

a plate structure in the nut plate assembly moves between a plurality of clamping plates through the screw rod and the guide rod and also drives an unlocking pin in the nut plate assembly and a position plate location hole in the position plate assembly for fit-locking or unlocking; and a hook end of the unlocking piece passes through the crank limit slot which is provided at one output shaft in the guide shell.

* * * * *